US006854149B1

(12) United States Patent
Specht et al.

(10) Patent No.: US 6,854,149 B1
(45) Date of Patent: Feb. 15, 2005

(54) MOPS AND MOP COMPONENTS

(75) Inventors: Paul B. Specht, Wilmette, IL (US); Edgar Wagner, Chicago, IL (US)

(73) Assignee: Freudenberg Household Products LP, River Grove, IL (US)

( * ) Notice: Subject to any disclaimer, the term of this patent is extended or adjusted under 35 U.S.C. 154(b) by 0 days.

(21) Appl. No.: 09/514,711

(22) Filed: Feb. 28, 2000

(Under 37 CFR 1.47)

Related U.S. Application Data

(63) Continuation of application No. PCT/US98/00637, filed on Jan. 15, 1998.
(60) Provisional application No. 60/057,088, filed on Aug. 27, 1997.

(51) Int. Cl.[7] ..... A47L 13/146; A47L 13/144
(52) U.S. Cl. ..... 15/119.2
(58) Field of Search ..... 15/116.2, 119.2

(56) References Cited

U.S. PATENT DOCUMENTS

| | | | | |
|---|---|---|---|---|
| 2,699,563 | A | | 1/1955 | Duncan |
| 2,730,744 | A | * | 1/1956 | Vaughn |
| 2,733,467 | A | | 2/1956 | Garro |
| 2,779,959 | A | * | 2/1957 | Hvale |
| 2,852,794 | A | | 9/1958 | Blum |
| 2,959,799 | A | * | 11/1960 | Greenleaf |
| 5,042,105 | A | | 8/1991 | Buck et al. |
| 5,131,111 | A | | 7/1992 | Richardson et al. |
| 5,272,783 | A | * | 12/1993 | Richardson |
| 5,522,110 | A | | 6/1996 | Borofsky |
| 5,887,309 | A | | 3/1999 | Lin |
| 5,979,004 | A | | 11/1999 | Wilson |
| 6,000,087 | A | | 12/1999 | Petner |
| 6,217,244 | B1 | | 4/2001 | Chen et al. |

FOREIGN PATENT DOCUMENTS

| | | | |
|---|---|---|---|
| CA | 767342 | | 9/1967 |
| GB | 932579 | | 7/1963 |
| GB | 2258142 | * | 2/1993 |

* cited by examiner

*Primary Examiner*—Randall Chin
(74) *Attorney, Agent, or Firm*—Leydig, Voit & Mayer, Ltd.

(57) ABSTRACT

Disclosed is a butterfly mop having an elongate shaft with a channel body disposed at one end of the shaft, the channel body having first and second leg portions defining a channel therebetween, the mop further having a mop element including a foldable, compressible, liquid-absorbent member. The mop element and channel body are hingedly movable along a hinge line relative to one another, whereby the mop element may be drawn into the channel causing the mop element to fold along a transverse axis and to become compressed between the channel body leg portions. A manual actuation mechanism includes a handle and a tension rod connecting the handle to one of the mop element and channel body for effecting relative hinged movement thereof. The mop element preferably includes plural pairs of apertures for allowing mounting of the mop element to variously sized mop element supports.

26 Claims, 6 Drawing Sheets

FIG. 1
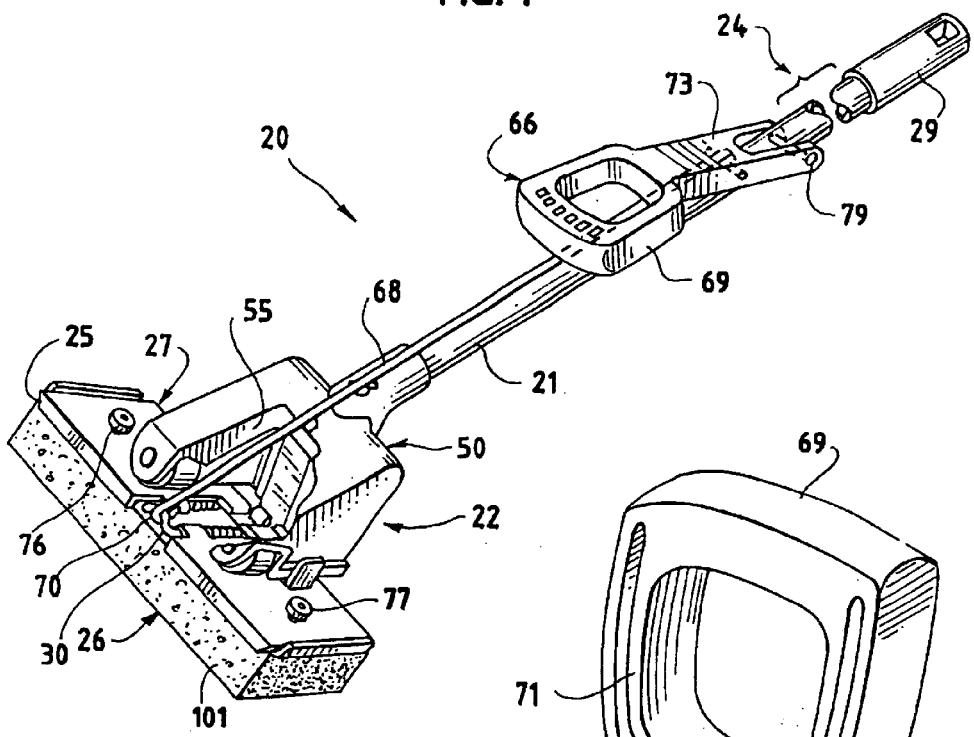
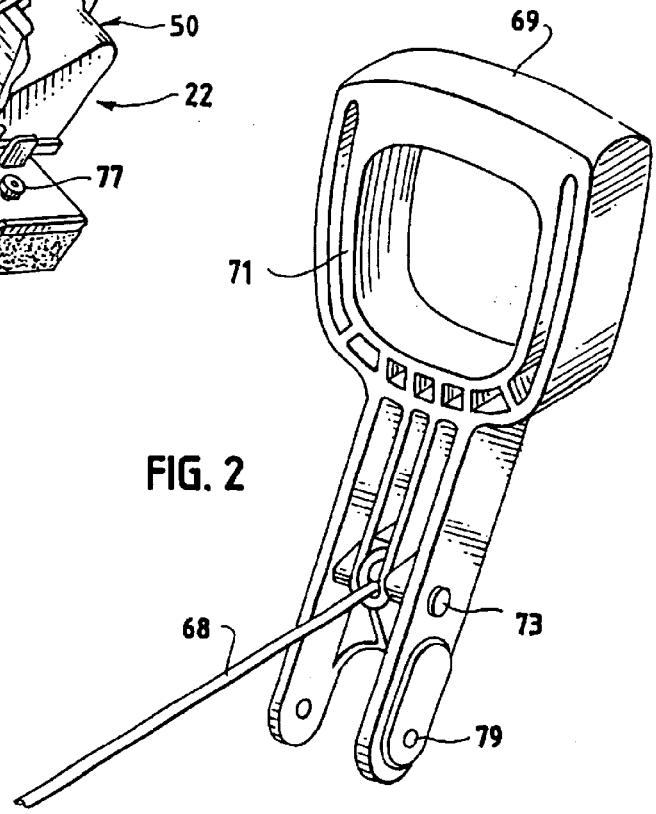
FIG. 2

MOPS AND MOP COMPONENTS

RELATED APPLICATION

This application claims priority to U.S. patent application Ser. No. 60/057,088, filed Aug. 27, 1997, the disclosure of,which is hereby incorporated by reference in its entirety.

This is a continuation of copending application(s) International Application No. PCT/US98/00637, filed Jan. 15, 1998, and which designates the U.S. The entire contents of this International Application are hereby incorporated by reference.

TECHNICAL FIELD OF THE INVENTION

The present invention is directed toward mops, and more specifically, is in the field of butterfly mops.

BACKGROUND OF THE INVENTION

A butterfly mop is characterized in that it comprises an elongate, foldable, compressible, liquid-absorbent member, such as a sponge, which is disposed at one end of a mop shaft, and which is used to absorb liquid, typically water, from a surface. When it is desired to expel liquid from the absorbent member, portions of the absorbent member are folded over one another along a transverse axis of the absorbent member and are compressed, using a folding mechanism such as a roller or track. Butterfly mops are so named because the folding and unfolding of the absorbent member along its transverse axis is said to resemble the motion of the wings of a butterfly.

One typical butterfly mop is shown in U.S. Pat. No. 2,892,201. As shown therein, the butterfly mop includes an elongate liquid absorbent member, a plate connected to a surface of each "wing" of the liquid absorbent member, and an activating rod pivotally connected to a portion of each of the plates adjacent the other plate. The plates are drawn along the dual arms of a yoke-like track to thereby fold the liquid absorbent member over onto itself and to compress the liquid absorbent member within a compression space disposed between and defined by the dual arms of the track. Numerous other butterfly mops are known in the prior art.

A common problem with conventional butterfly mops is the difficulty inherent in manually applying sufficient force to the actuating mechanism to fold the liquid absorbent member over onto itself and to compress the liquid absorbent member sufficiently to satisfactorily expel liquid therefrom. Indeed, in typical butterfly mops, substantial physical effort may be required to compress the absorbent member. Another drawback lies in the difficulty of removing a spent liquid absorbent member and of attaching a new liquid absorbent member. Known absorbent members typically are sized to be received by and supported on only one type of mop. A liquid absorbent member from one mop often will not fit on a second mop, and thus retailers must stock many different sizes of mop elements.

It is a general object of the present invention to provide a mop that overcomes these drawbacks of earlier mops.

SUMMARY OF THE INVENTION

The invention overcomes these drawbacks by providing a mop including a channel body comprising spaced-apart first and second leg portions defining a channel therebetween. The channel body uniquely cooperates with an elongate mop element comprising a foldable, compressible liquid absorbent member. In accordance with the invention, the channel body and mop element are disposed in a relatively hinged relationship with respect to one another along a hinge line lying along a longitudinal axis of the mop element. The mop element and the channel body are relatively movable over a range of travel between an open mop element position and a closed position wherein the mop element is folded about a central transverse portion and is rotated to a position within the channel. A tension rod connects a manually operable handle to the central portion of the mop element remote from the channel hinge portion for effecting relative hinged movement of the mop element and the channel body. When tension is applied to the rod, the liquid absorbent member is drawn into the channel and is compressed therewithin to thereby expel water therefrom, the mop element folding about its transverse central portion upon compression. The relatively hinged relationship of the mop element and the channel body and the butterfly action of the absorbent member provides a leveraged relationship that effectively multiplies the force applied by an operator to fold and compress the mop element. This leveraged relationship reduces the manual force necessary to draw the absorbent member into the channel to thereby expel liquid therefrom. In accordance with preferred embodiments of the invention, the actuating handle is pivotally mounted to the shaft about a pivot axis, and comprises an elongate member terminating in an operator gripping portion, whereby a pivotal motion of the gripping portion relative to the shaft creates tension in the rod.

In accordance with particularly preferred embodiments of the invention, the mop includes a mop element support having a first wing, and a second wing, and a link portion supported on the body and including a liquid absorbent mop element mounted on the wings. In this embodiment, the first leg portion of the channel body includes a first roller rotatably journalled thereto and engaging the first wing, and the second leg portion includes a second roller rotatably journalled thereto and engaging the second wing. The rollers and wings serve to guide the liquid absorbent mop element into the channel.

In accordance with a highly preferred embodiment of the invention, the mop element includes a compressible liquid absorbent outer layer and a flexible, relatively tough inner layer adapted to overlie the mop element support. The wings of the support are provided with apertures which align respectively with apertures in the inner layer of the mop element. Fasteners are used to maintain the inner layer against the support. Most preferably, the fasteners comprise a rivet portion having an apertured head and a longitudinally slotted outer sleeve, and an inner pin portion having a headed end and an operative end opposite thereof. By introducing the headed end of the pin portion into the slot of the rivet portion, the pin engages and enlarges the outer sleeve to removably retain the inner layer and wing together. By so attaching the mop element to the mop element support, the mop element may be quickly and easily removed when spent, and may be readily replaced with a fresh mop element. The mop element may be provided with plural apertures sized to fit a variety of mop element supports.

DESCRIPTION OF THE DRAWINGS

FIG. 1 is a perspective view, partially cut-away, of the mop of the invention.

FIG. 2 is an enlarged perspective view of the operator handle of the mop shown in FIG. 1.

Figure 3:
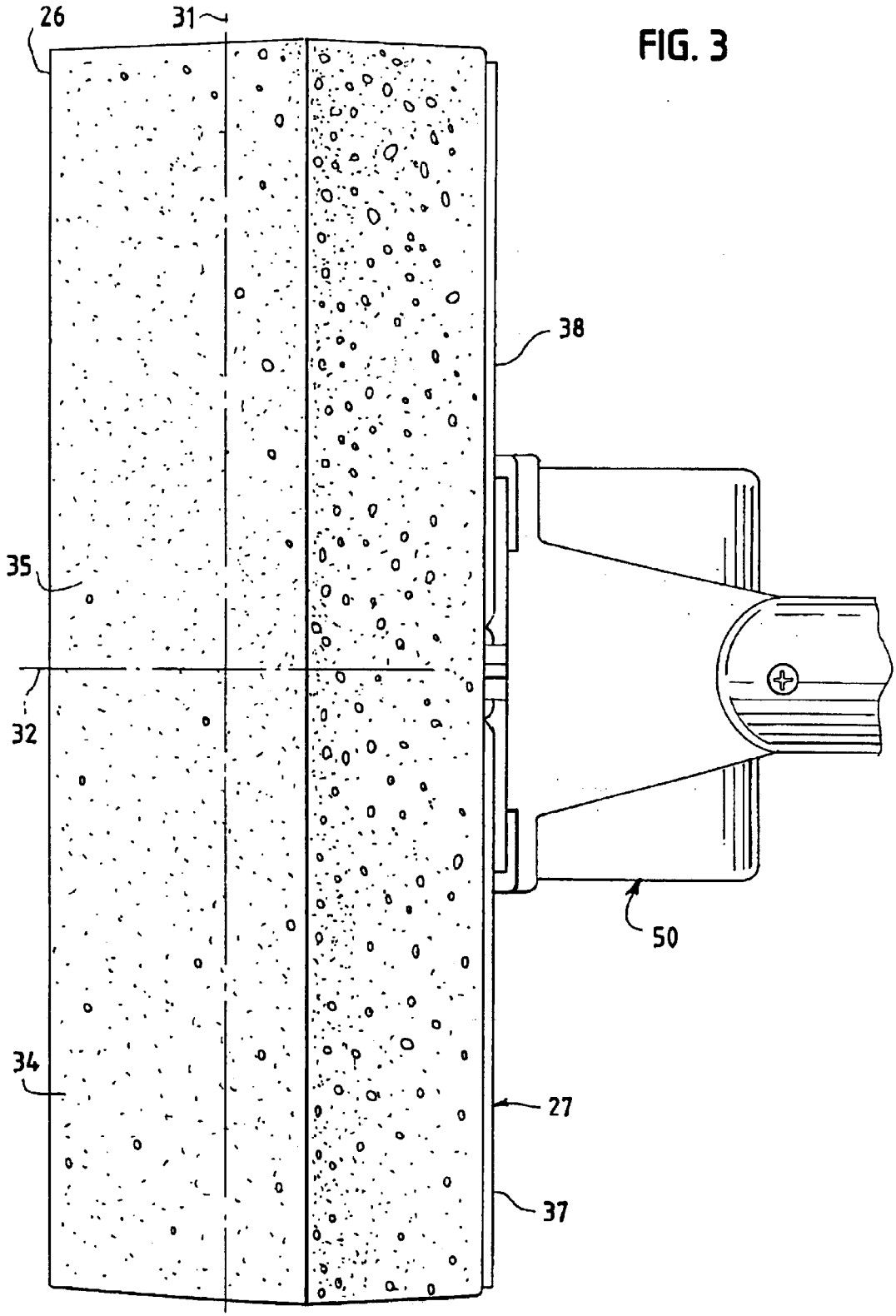
FIG. 3 is an enlarged plan view of the mop element end of the mop shown in FIG. 1, illustrating the mop element in an upwardly facing position.

While the foregoing drawings are described with reference to the "upwardly" and "downwardly" facing positions, it should be understood that these designations refer to the floor engaging position and are for convenient reference only. In practice, the mop of the invention has no spatial orientation.

DESCRIPTION OF THE INVENTION

Referring now to FIGS. 1–4, the butterfly mop 20 generally includes a mop shaft 21 having a mopping end 22 and a gripping end 24. Disposed at the mopping end 22 is a mop element assembly 25 including a mop element 26 and a mop element support 27. The mop element 26 includes an absorbent member of spongy material as shown in FIG. 1 and a flexible, relatively tough inner layer (not shown in FIG. 1) which is secured to the support 27, by fasteners 76, 77. At the gripping end 24 of the mop shaft 21 is disposed a hanger clip 29 for supporting the mop for storage.

Figure 4:
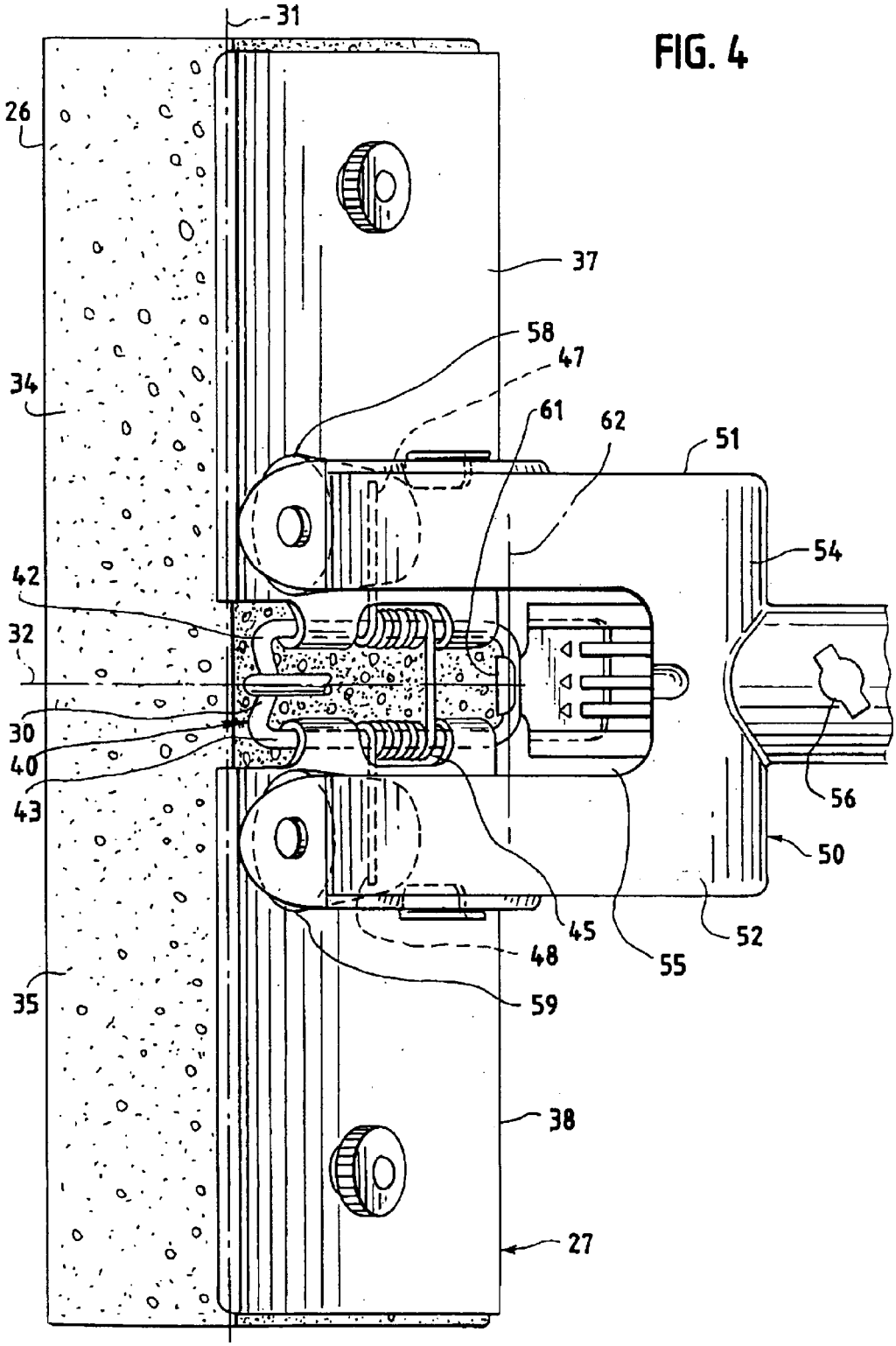
FIG. 4 is an enlarged plan view, partially cut-away, of the mop element end of the mop shown in FIG. 1, illustrating the mop element in a downwardly facing position.

With particular reference to FIGS. 3 and 4, the mop element 26 comprises a flexible, compressible absorbent member which absorbs liquid and from which liquid may be expelled upon compression thereof. The mop element has a longitudinal axis 31 and a central transverse axis 32 generally perpendicular to the longitudinal axis 31. The central axis 32 divides the mop element generally into two regions, a first region 34 and a second region 35. The mop element is disposed on the mop element support 27, which support comprises a first wing 37 and a second wing 38 generally coinciding with respective regions 34, 35 of the mop element 26. As shown more particularly in FIG. 4, the support 27 includes a link 40 connected to the wings 37, 38 such that the wings are hingedly secured to first and second link arms 42, 43, respectively. The support further includes biasing means for urging the wings and the respective mop element regions toward longitudinally aligned positions. Preferably, the biasing means comprises a dual coiled spring 45 having first and second legs 47, 48 (shown in phantom in FIG. 4) engaging the respective wings 37, 38. Alternatively, the biasing means may comprise two single coil springs (not shown) or another suitable spring mechanism.

The mop further includes a channel body 50, as shown, for example, in FIGS. 1, 3, and 4. With reference to FIG. 4, the channel body 50 includes a first leg 51 and a second leg 52 connected by a bight portion 54, and a channel 55 generally defined by a space between the first leg 51 and the second leg 52. First and second rollers 58, 59 are rotatably journalled respectively on the first and second legs 51, 52 and positioned continuously to engage respectively the first and second wings 37, 38. The channel body 50 may be secured to the shaft by any suitable means, such as by fastener 56 as shown in FIG. 4.

In accordance with the invention, the mop element 26 is disposed in a relatively hinged relationship with respect to the channel body 50. In a preferred embodiment, the link 40 of the mop element support 27 is connected to the channel body 50 at a trunnion 61, as illustrated in FIG. 4. The hinged mounting of the link 40 in the trunnion 61 defines a hinge line 62 across the width of the link 40, which hinge line is generally perpendicular to the transverse central axis 32 of the mop element 26. The hinged relationship between the mop element 26 and the channel body 50 and the wedging action as the wings 37, 38 are drawn between the rollers 58, 59 provides effective multiplication of the force applied to the mop element 26 as it is drawn into the channel body 50, thus easing the wringing operation. Tabs disposed in the wing may be provided to inhibit translation of the mop element along its longitudinal axis.

An actuation mechanism 66 is provided for wringing the mop, as shown in FIG. 1. The actuation mechanism 66 preferably comprises a tension rod 68 having an operator end connected to a handle 69. As shown in FIG. 2, the handle 69 is generally elongate and includes an operator gripping portion 71, a pivotal connection 73 to the tension rod 68 and a pivot 79 for connection to mop shaft (not shown in FIG. 2). The tension rod is operatively connected to the mop element assembly 25, and preferably is connected to the mop element 26 via the mop element support 27. By applying tension to the tension rod 68, the operator causes the mop element 26 to move hingedly with respect to the channel body 50 and to be drawn into and compressed within the channel 55.

Figure 5:
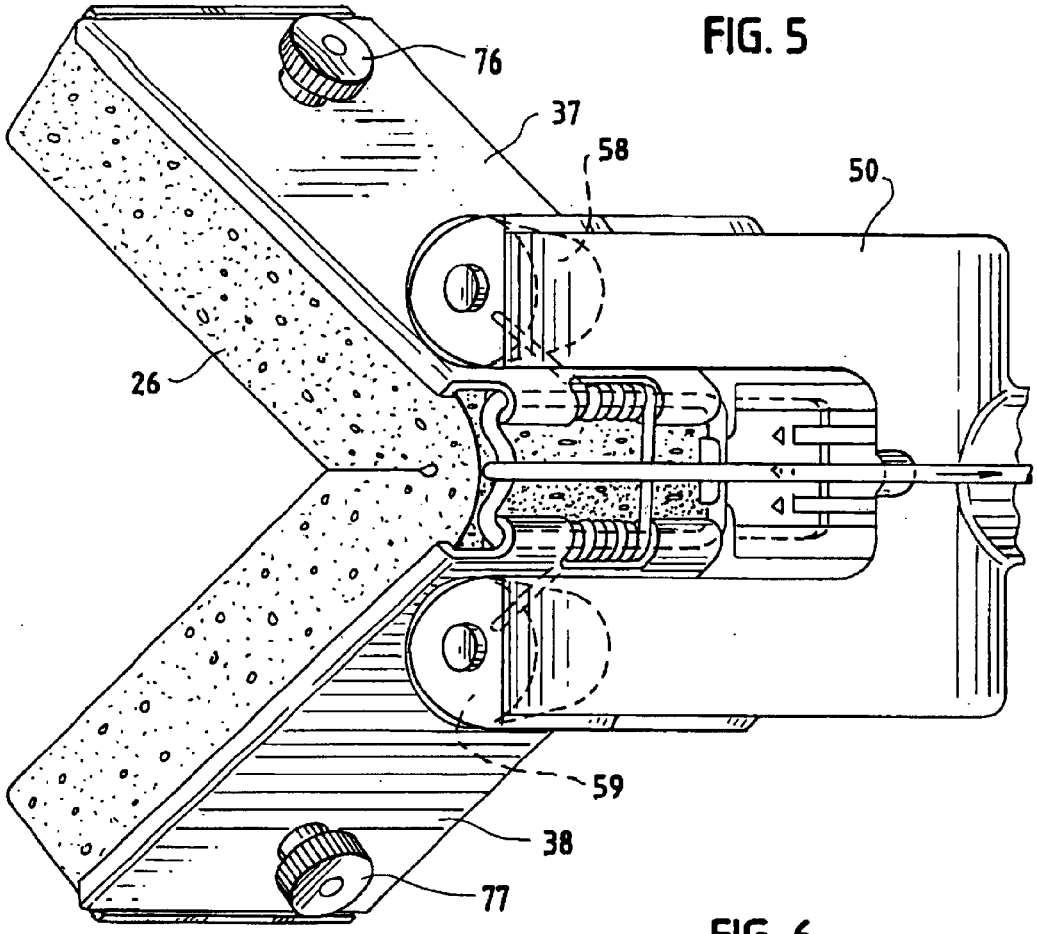
FIG. 5 is an enlarged plan view of the mop element end shown in FIGS. 1–4 showing the mop element as it is being drawn into the channel body.
Figure 6:
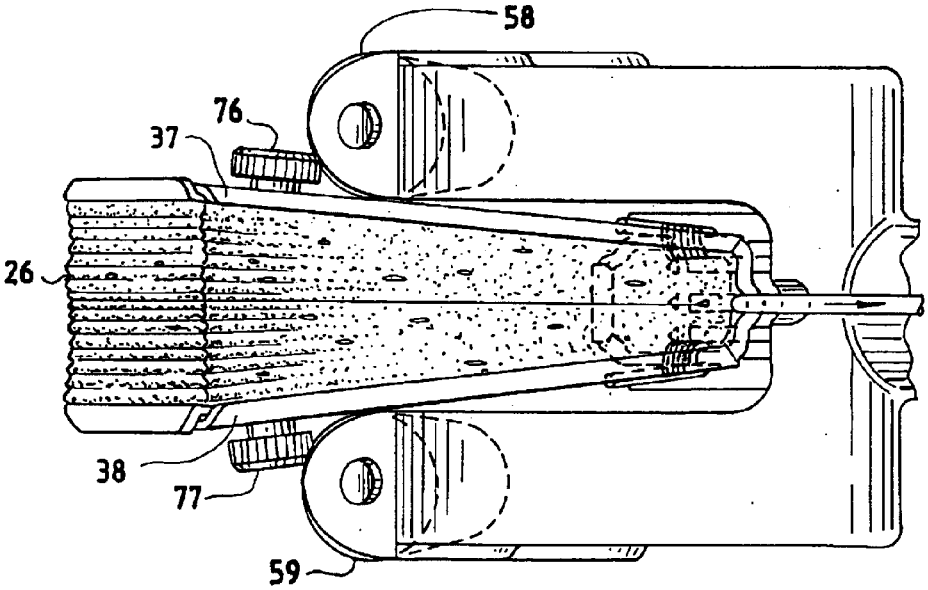
FIG. 6 is an enlarged plan view of the mop element end shown in FIGS. 1–5, showing the mop element fully withdrawn into the channel body.
Figure 7:
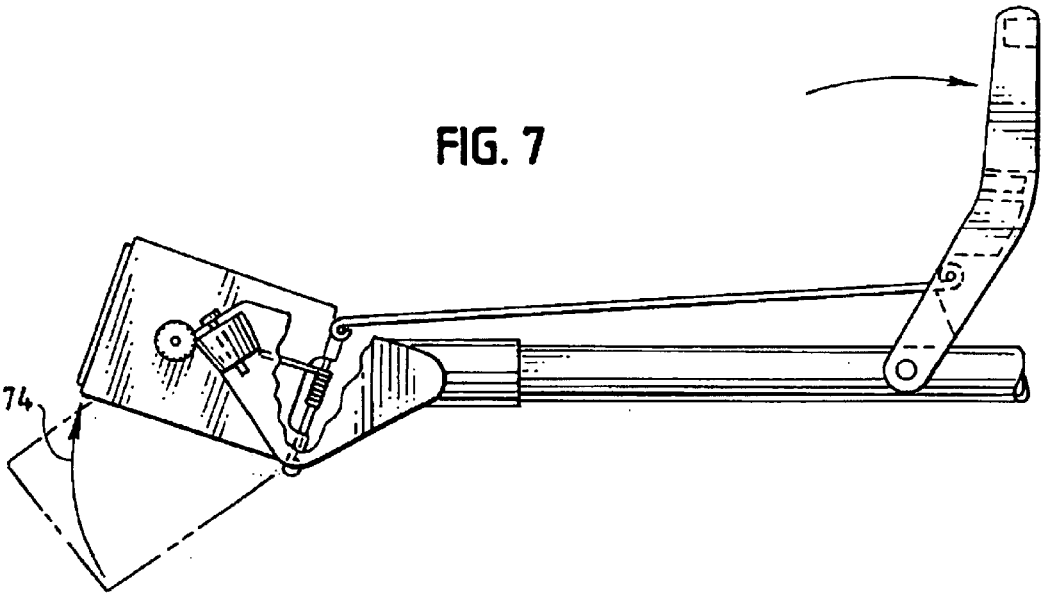
FIG. 7 is a side representational view of the mop of FIGS. 1–6, showing the mop element fully withdrawn into the channel body as shown in FIG. 6.

Operation of the mop is progressively illustrated in the plan views of FIGS. 4–6 and in the side view of FIG. 7. The mop element is shown in a mopping position in FIG. 4. When it is desired to expel liquid from the mop element, tension is applied to the tension rod 68 (shown in FIGS. 5 and 6) whereupon the mop element 26 begins to fold along the central transverse axis 32 and to be drawn into the channel body 50. FIG. 5 illustrates the mop element when partially drawn into the channel body, and FIGS. 6 and 7 illustrate the mop element when fully withdrawn into the channel body. During operation, the wings 37, 38 travel in a complex path including a generally arcuate path, as illustrated by arrow 74 in FIG. 7. In the embodiment illustrated in FIGS. 5 and 6, the mop element is secured to the mop element support with screw-type fasteners 76, 77 which pass through apertures in the wings 37 and 38 and which are secured in threaded apertures in the inner layer of the mop element 26.

The operator handle 69 is pivotally mounted to the shaft 21 at the pivotal mounting 79 as shown, for example, in FIG. 1. In the embodiment shown in FIG. 1, the tension rod 68 has an eyelet 70 which extends around a shaped intermediate portion 30 of link 40 between arms 42 and 43. The rod 68 is also secured to the handle 69 at a pivotal connection 73 disposed between the handle operator gripping portion and the pivotal mounting of the handle on the shaft as a second order lever.

Figure 11:
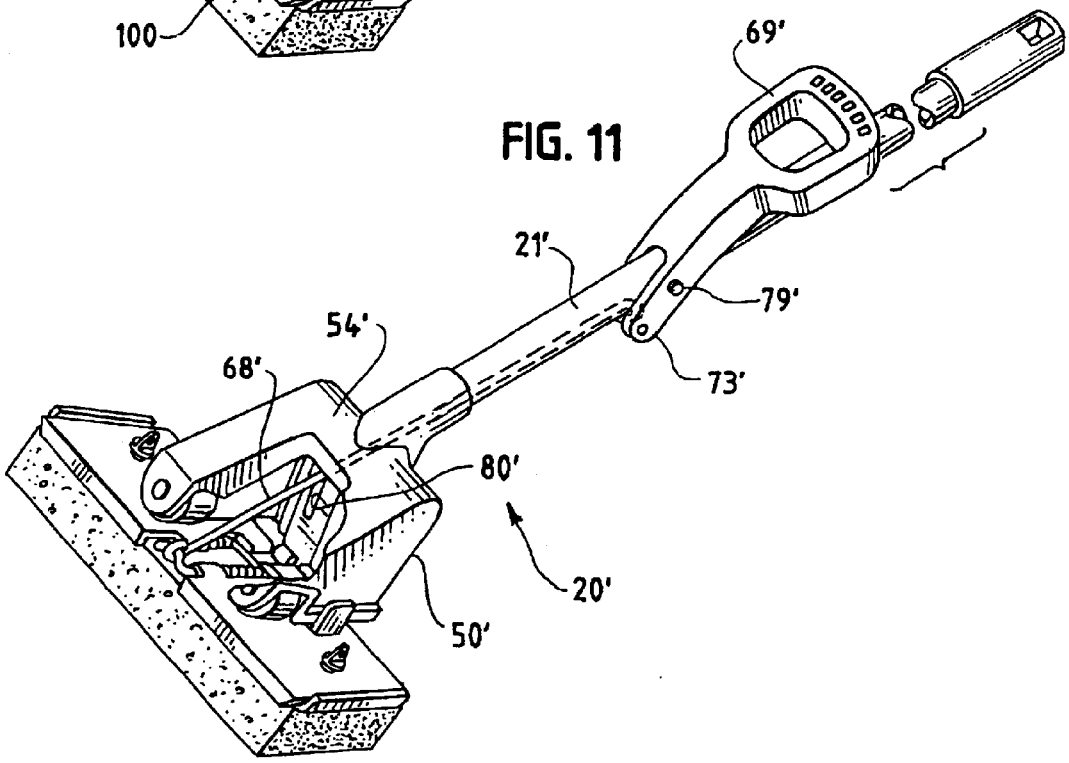
FIG. 11 is a perspective view of an alternative embodiment of the mop of the present invention.

FIG. 11 illustrates an alternative embodiment of the mop 20' of the invention utilizing a handle 69' having a central pivot point 79'. The tension rod 68' is disposed on the opposite end of the shaft 21' and is secured to the handle 69' at pivot 73'. In this embodiment, the tension rod extends through an aperture 80' in the connecting portion 54' of the channel body 50'. The pivotal mounting 79' of the handle 69' to the shaft 21' is disposed between the operator gripping portion of the handle 69' and the pivotal connection 73' of the handle 69' to the tension rod 68' as a first order lever.

Figure 8:
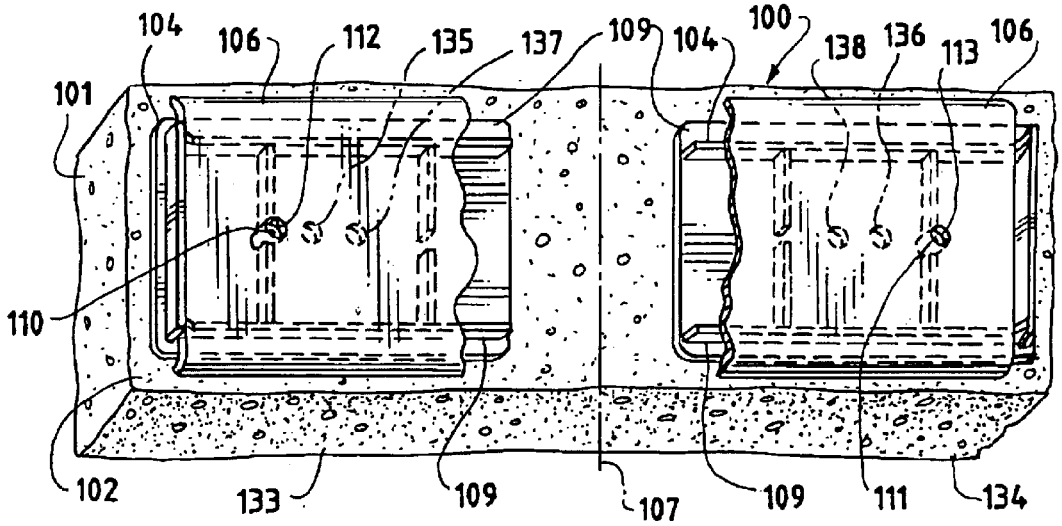
FIG. 8 is a perspective view, partially cut away, of the mop element assembly of the mop of the invention, illustrating the mop element and a portion of the mop element support.

A preferred embodiment of the mop element of the invention is illustrated in FIG. 8. In this embodiment, the mop element 100 is a laminar structure, and comprises a compressible liquid absorbent member 101 having a support surface 102, which preferably is a generally planar surface. Overlying at least a portion of the support surface is a flexible, relatively tough inner layer 104, which preferably is made of plastic, such as polypropylene. The inner layer 104 is adapted to overlie a mop element support 106 (partially shown in FIG. 8). The inner layer 104 may be continuous, but is preferably discontinuous across the central transverse axis 107 of the mop element 100, and preferably includes spacing ribs 109 on at least a portion thereof.

Many known mop elements designed for use with butterfly mops include two upwardly and inwardly extending threaded posts positioned for alignment with respective holes in the mop element support. The mop element is secured to the support by inserting the posts into the aligned apertures and securing the post with a threaded cap. In accordance with the present invention, the mop element 100 instead has at least one aperture, and preferably includes at least a pair of apertures 110, 111, which are positioned for alignment with respective holes 112, 113 in the mop element support. To secure the mop element to the support, a fastener, and preferably a pair of fasteners, are provided. Each fastener is separate from the mop element and includes a post portion for extending through the aligned apertures in the mop element and mop element support, the fastener engaging the mop element and mop element support to thereby releasably secure the mop element to the support.

Figure 9:
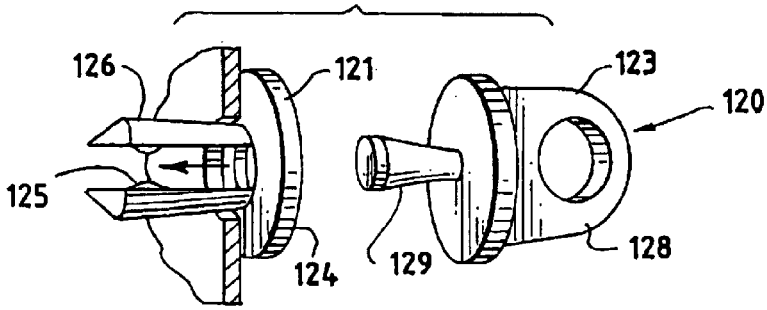
FIG. 9 is a perspective view of a fastener useful in conjunction with the present invention.
Figure 10:
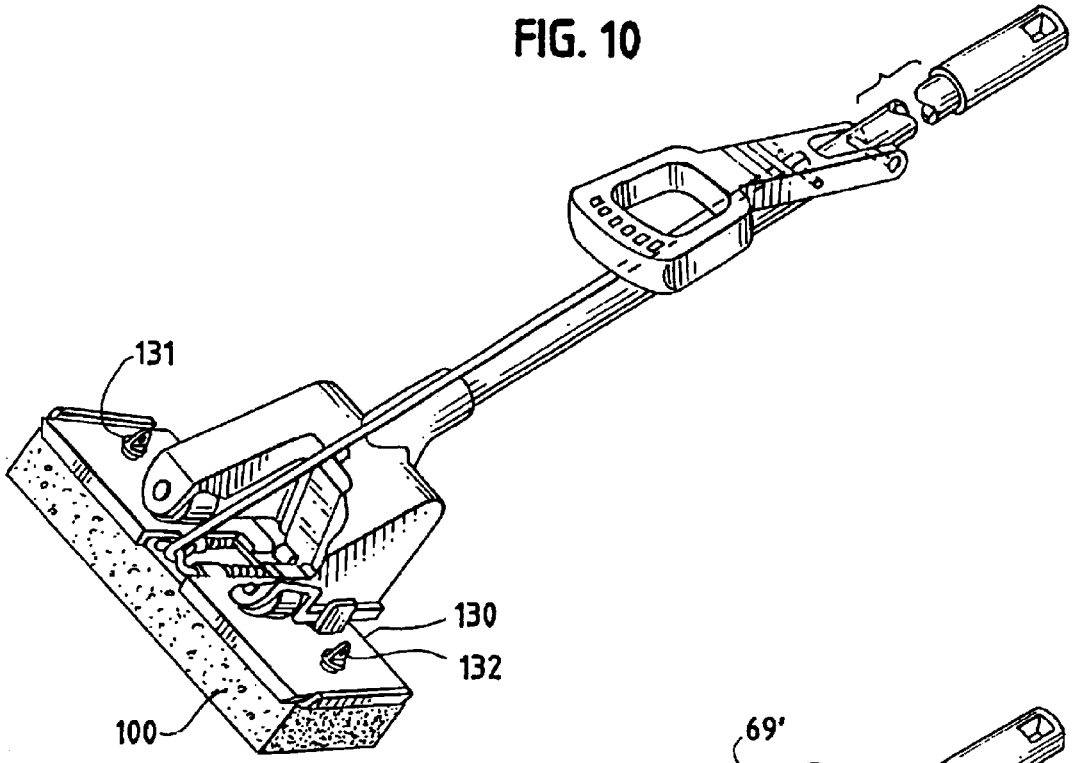
FIG. 10 is a perspective view of one embodiment of the invention, showing the mop element secured to the mop element support with two of the fasteners shown in FIG. 9.

In accordance with one preferred embodiment of the invention, the fasteners comprise removable rivets, such as those rivets sold under the trademark TUFLOK® by ITW Fastex®. For example, as illustrated in FIG. 9, the removable rivet 120 comprises a rivet portion 121 and an inner plug portion 123. The rivet portion has a headed end 124 and a longitudinally slotted outer sleeve 126 with an inward annular projection 125 adjacent the slotted portion thereof. The inner plug has a head 128 and an operative tapered pin 129 opposite the head 128. The operative pin 129 of the plug 123 is inserted into the sleeve when the headed portions 124, 128 of the respective rivet portion 121 and pin portion 123 are longitudinally spaced, and when the pin portion 123 is longitudinally moved toward the headed end 124 of the rivet portion 121. When the pin is partially extended through the sleeve 126, the pin engages the inner annular projection 125 and enlarges the sleeve 126 to secure the rivet in place. FIG. 10 illustrates an embodiment of the mop of the invention wherein the mop element 100 is secured to the mop element support 130 via two removable rivets 131, 132. The invention is not limited to the foregoing types of fasteners, and indeed other fasteners can be used in conjunction with the invention. For example, it is contemplated that the aperture, in the mop element may include screw threads, and the fastener may include a shank portion having threads or other projections for engaging the screw threads in the mop element, thereby allowing the shank portion to be screwed and/or pushed into the aperture and thereby secured.

In accordance with a highly preferred embodiment of the invention, as shown in FIG. 8, the mop element 100 has a central transverse axis 107 dividing the mop element into two regions 133, 134, and includes inner layer portions 104 having plural apertures in each region 133, 134. For example, the mop element 100 shown in FIG. 8 includes apertures 135, 136, which define a second pair of apertures positioned for alignment with respective apertures in a second mop element support (not shown). Thus, the mop element may be secured to mop element supports of various sizes. For example, in FIG. 8, apertures 110, 111 are aligned with respective apertures 112, 113 in the mop element supports. However, it is contemplated that the pair of apertures 135, 136 could be used to secure the mop element 100 to a support having differently spaced apertures (not shown) which apertures align respectively with apertures 135, 136. The mop element shown in FIG. 8 further includes a third pair of apertures 137, 138 for mounting to yet a third mop element support (not shown).

The mop element of the invention is not limited to the configuration shown. For example, the apertures in the mop element may be positioned in any location necessary for alignment with respective apertures in any number of mop element supports. Similarly, while the fastener shown in FIG. 9 is the preferred embodiment of the fastener useful in conjunction with the invention, it is contemplated that other forms of fasteners could be employed. The mop element and one or more fasteners may be provided in the form of a kit, the kit being adapted for securing the mop element to several differently sized mop element supports.

Thus, it is seen that the invention has overcome the drawbacks inherent in the prior art, and has achieved the foregoing general objects. The relatively hinged relationships between the respective wings and between the mop element and the channel body allow a user readily to apply sufficient force to the actuating mechanism to fold the liquid absorbing mop element over onto itself and to compress the mop sufficiently to satisfactorily expel liquid therefrom. Moreover, the mop element and kit of the invention are versatile, and allow a single mop element to be supported on variously sized mop element supports. Thus, a retailer need only carry one brand or type of mop element, rather than different replacements for a variety of mops.

While particular embodiments of the invention have been shown, it will be understood that the invention is not limited thereto since modifications may be made by those skilled in the art, particularly in light of the foregoing teachings. It is, therefore, contemplated by the appended claims to cover any such modifications as incorporate those features which constitute the essential features of these improvements within the true spirit and scope of the invention.

What is claimed is:

1. A mop comprising:

an elongate shaft having a mopping end and a gripping end;

a channel body disposed at said mopping end of said shaft and comprising spaced-apart first and second leg portions defining a channel therebetween;

a mop element comprising a flexible, compressible, elongate liquid absorbent member, said mop element having a central axis, said mop element being disposed in a relatively hinged relationship with respect to said channel body along a hinge line, said hinge line being generally perpendicular to said central axis;

an elongate rod having an operator end and operatively connecting said operator end to one of said mop element and said channel body, whereby the application of longitudinal force in said rod relative to the other of said mop element and said channel body causes relative hinged movement of said mop element and said channel body about said hinge line thereby drawing said mop element into said channel and causing said mop element to fold at said central axis and to become compressed between said channel body portions, and an operator handle, said operator handle including a gripping portion, a pivotal mounting on said shaft, and a pivotal connection to said operator end of said rod whereby pivotal motion of said gripping portion relative to said shaft creates tension in said rod.

2. A mop according to claim 1, said central axis dividing said absorbent member into first and second portions, said mop including a mop element support including a first wing connected to said first portion of said absorbent member and a second wing connected to said second portion of said absorbent member.

3. A mop according to claim 2, said mop element support including biasing means urging said first and second wings and mop element portions toward a coplanar relationship.

4. A mop according to claim 2, said mop element support including a link connecting said first wing to said second wing, said wings being hingedly connected to said link.

5. A mop according to claim 4, wherein said link has a first arm and a second arm, said first wing being hingedly connected to said link at said first arm and said second wing being hingedly connected to said link at said second arm.

6. A mop according to claim 1, said channel body having a connecting portion interlinking said first and second leg portions.

7. A mop according to claim 6, said rod extending through said connecting portion.

8. A mop according to claim 6, said rod extending around said connecting portion.

9. A mop comprising:

an elongate shaft having a mopping end and an operator end;

a channel body disposed at the mopping end of said shaft and comprising a first channel body leg and a second channel body leg defining a channel therebetween;

an elongate mop element support having a first wing, a second wing, and a link therebetween, said link being hingedly secured along its length to said first wing and to said second wing, said link having a hinge axis across its width corresponding to the width of said channel, said support being mounted for rotation about said axis within said channel;

a flexible, compressible, liquid absorbent mop element overlying said support and having first and second regions secured to first and second wings respectively; and a tension rod generally aligned with said shaft, and pivotally secured to a position on said link displaced from said hinge axis, whereby the application of tension in said rod relative to said shaft rotates said link about said hinge axis to rotate said wings relative to said legs and relative to said link whereby said wings are closed together to a compressed position between said legs.

10. The mop of claim 9 wherein said pivotal connection is disposed between the gripping end and the pivotal mounting.

11. The mop of claim 9 including bias means urging said wings and said first and second regions apart hingedly.

12. The mop of claim 11, said bias means comprising a spring.

13. The mop of claim 9 including a roller rotatably mounted at the end of each leg and engaging the respective ling whereby rotation of said link causes said wings to roll in an arcuate path relative to said legs about said hinge axis.

14. The mop of claim 9 wherein said mop element includes a compressible, liquid absorbent outer layer and a flexible tough inner layer adapted to overly the support, said inner layer being in alignment with said wings and detachably secured thereto.

15. The mop of claim 14 wherein each wing has a wing aperture and said inner layer has an aperture aligned with each wing aperture and a fastener disposed in each wing aperture and engaging the respective aperture in said inner layer whereby said inner layer is maintained against said support.

16. A mop comprising:

an elongate shaft having a mopping end and an operator end;

a mophead disposed at the mopping end of said shaft and including a body supported at the mopping end and said mophead defining a mop element plane and a central channel extending into said body from said mop element plane toward said operator end, and an elongate, flexible compressible, liquid absorbent mop element having a central transverse section supported on said body along said plane and having ends extending longitudinally outwardly therefrom, one end portion of said central transverse section being hingedly supported in said channel; and a rod generally aligned with said shaft and pivotally secured adjacent the other end of said central transverse section, whereby longitudinal force in said rod relative to said shaft rotates said central transverse section about said one portion whereby said ends are closed together within said channel to compressed positions.

17. A mop comprising:

an elongate shaft having a mopping end and a gripping end;

a channel body disposed at said mopping end of said shaft and comprising spaced-apart first and second leg portions defining a channel therebetween;

a mop element comprising a flexible, compressible, elongate liquid absorbent member, said mop element having a central axis, said mop element being disposed in a relatively hinged relationship with respect to said channel body along a hinge line, said hinge line being generally perpendicular to said central axis, said central axis dividing said absorbent member into first and second portions, said mop including a mop element support including a first wing connected to said first portion of said absorbent member and a second wing connected to said second portion of said absorbent member, said mop element support including a link connecting said first wing to said second wing, said wings being hingedly connected to said link, said link being connected to said channel body at a hinge trunnion, said hinge trunnion defining a hinge axis, said hinge line being defined by said hinge axis;

an elongate rod having an operator end and operatively connecting said operator end to one of said mop element and said channel body, whereby the application of longitudinal force in said rod relative to the other of said mop element and said channel body causes relative hinged movement of said mop element and said channel body about said hinge line thereby drawing said mop element into said channel and causing said mop element to fold at said central axis and to become compressed between said channel body portions.

18. The mop according to claim 17, wherein said mop element support includes a biasing means urging said first and second wings towards a coplanar relationship.

19. The mop according to claim 18, wherein said biasing means includes a dual-coiled spring having first and second legs respectively engaging said first and second wings.

20. The mop according to claim 18, wherein said biasing means includes a first coiled spring engaging the first wing and a second coiled spring engaging the second wing.

21. The mop according to claim 17, wherein said link has a first arm and a second arm, said first wing hingedly connected to said first arm and said second wing hingedly connect to said second arm.

22. The mop according to claim 17, wherein said first leg portion includes a first roller rotatably journaled thereon and engaging said first wing, and said second leg portion includes a second roller rotatably journaled thereon and engaging said second wing.

23. A mop comprising:

an elongate shaft having a mopping end and a gripping end;

a channel body disposed at said mopping end of said shaft and comprising spaced-apart first and second leg portions defining a channel therebetween;

a mop element comprising a flexible, compressible, elongate liquid absorbent member, said mop element having a central axis, said mop element being disposed in a relatively hinged relationship with respect to said channel body along a hinge line, said hinge line being generally perpendicular to said central axis, said central axis dividing said absorbent member into first and second portions, said mop including a mop element support including a first wing connected to said first portion of said absorbent member and a second wing connected to said second portion of said absorbent member;

an elongate rod having an operator end and operatively connecting said operator end to one of said mop element and said channel body, whereby the application of longitudinal force in said rod relative to the other of said mop element and said channel body causes relative hinged movement of said mop element and said channel body about said hinge line thereby drawing said mop element into said channel and causing said mop element to fold at said central axis and to become compressed between said channel body portions;

wherein said first leg portion includes a first roller rotatably journaled thereon and engaging said first wing, said second leg portion includes a second roller rotatably journaled thereon and engaging said second wing, whereby said relative hinged movement of said mop element and said channel body causes said wings to roll in a generally arcuate path relative to said channel body leg portions.

24. The mop according to claim 23, wherein said mop element support includes a biasing means urging said first and second wings towards a coplanar relationship.

25. The mop according to claim 24, wherein said biasing means includes a dual-coiled spring having first and second legs respectively engaging said first and second wings.

26. The mop according to claim 24, wherein said biasing means includes a first coiled spring engaging the first wing and a second coiled spring engaging the second wing.

* * * * *